US006793811B1

(12) United States Patent
Fleischmann

(10) Patent No.: US 6,793,811 B1
(45) Date of Patent: Sep. 21, 2004

(54) RUNOFF DRAIN FILTER WITH SEPARATELY REMOVABLE CARTRIDGES

(76) Inventor: Charles R. Fleischmann, 164 Danefield Pl., Moraga, CA (US) 94556

( * ) Notice: Subject to any disclaimer, the term of this patent is extended or adjusted under 35 U.S.C. 154(b) by 0 days.

(21) Appl. No.: 10/119,469

(22) Filed: Apr. 10, 2002

(51) Int. Cl.[7] ..... E03F 5/06

(52) U.S. Cl. ..... 210/163; 210/170; 210/238; 210/323.2; 210/470; 210/474; 404/4

(58) Field of Search ..... 210/163, 164, 210/170, 232, 238, 323.2, 346, 433.1, 470, 471, 474, 475; 404/4, 5

(56) References Cited

U.S. PATENT DOCUMENTS

| | | | | |
|---|---|---|---|---|
| 1,041,887 A | * | 10/1912 | Schodde | 210/163 |
| 1,070,773 A | * | 8/1913 | Callahan | 210/164 |
| 1,471,819 A | * | 10/1923 | Bauschard | 404/5 |
| 3,815,748 A | * | 6/1974 | Johannessen | 210/163 |
| 4,552,661 A | * | 11/1985 | Morgan | 210/323.2 |
| 5,284,580 A | * | 2/1994 | Shyh | 210/163 |
| 5,480,254 A | | 1/1996 | Autry et al. | |
| 5,632,889 A | | 5/1997 | Tharp | |
| 5,720,574 A | | 2/1998 | Barella | |
| 5,958,226 A | | 9/1999 | Fleischmann | |
| 6,200,484 B1 | * | 3/2001 | McInnis | 210/164 |
| 6,217,757 B1 | | 4/2001 | Fleischmann | |
| 6,533,941 B2 | * | 3/2003 | Butler | 210/163 |
| 6,537,447 B2 | * | 3/2003 | Remon | 210/163 |
| 6,602,408 B1 | * | 8/2003 | Berkey | 210/323.2 |

* cited by examiner

*Primary Examiner*—Christopher Upton
(74) *Attorney, Agent, or Firm*—Jack Lo

(57) ABSTRACT

A runoff drain filter is comprised of a tray for being supported inside a runoff drain. A plurality of separately removable cartridges are supported by the tray and aligned with holes in the tray. Each cartridge is comprised of a bucket and an insert. The insert is comprised of a central overflow tube centered in the bucket by a vented annular top plate and an annular bottom plate. Runoff pouring into the tray is directed into each bucket through the vented annular top plate. The runoff is filtered by a perforated tube which is part of the central overflow tube before it is discharged through an open bottom of the central overflow tube. Debris and contaminants are collected in the buckets. The total capacity of the filter is divided among the separately removable cartridges to enable a filled cartridge to be more easily lifted by an average person.

20 Claims, 8 Drawing Sheets

RUNOFF DRAIN FILTER WITH SEPARATELY REMOVABLE CARTRIDGES

BACKGROUND OF THE INVENTION

1. Field of the Invention

This invention relates generally to filters for filtering debris, gravel, hydrocarbons, and other contaminants from water flowing into runoff drains.

2. Prior Art

Runoff drains are provided in streets, parking lots, gas stations, and highways for draining water runoff. Some runoff drains are provided with internal filters for preventing debris, hydrocarbons, and other contaminants from entering waterways.

My prior U.S. Pat. No. 5,958,226 discloses a runoff drain filter sized to be positioned inside a runoff drain. It includes a top debris tray detachably positioned within a bottom media tray. Each tray includes a peripheral trough surrounding a central overflow opening. The top tray is shorter in height than the bottom tray, so that a filter media receiving chamber is defined between the top tray and the bottom tray. Filter medium is positioned in the filter medium receiving chamber. In a first embodiment, the bottom surfaces of the top and bottom trays are perforated. In a second embodiment, the bottom of the top tray and the inner wall of the bottom tray are perforated. In either embodiment, water flowing into the filter is distributed around the top trough, passed through the perforated surface of the top tray, the filter medium, the perforated surface of the bottom tray, and into the runoff drain. Hydrocarbons and other contaminants are filtered by the filter medium. Large particles and debris are collected in the trough of the top tray. The filter may be cleaned by lifting out the top tray, shaking out the debris, and replacing it in the bottom tray. However, the perforated surface of the top tray is relatively small, so that it may quickly clog when a large amount of debris flows into the filter. The top tray can be removed by lifting on its handle.

My prior U.S. Pat. No. 6,217,757 discloses another runoff drain filter with an annular debris trough, and concentric tubular vertical screens surrounding a central overflow opening in the annular trough. A filter media is positioned between the screens. As debris accumulate in the trough, the vertical screens will start clogging at the bottom, but the top will remain clear for continuing to filter the runoff.

U.S. Pat. No, 5,720,574 to Barella discloses a filter for being positioned inside a runoff drain. It includes a peripheral trough surrounding a central overflow opening. A set of cartridges containing filter medium are positioned in the trough. Water flowing into the drain is distributed around the trough, and passes through the cartridges before exiting through a screen on the bottom of the trough. When water flow is high, excess water overflows through the central opening without passing through the cartridges. However, gravel, leaves, and other debris accumulate on top of the cartridges and block water flow, so that a worker must reach in and dig them out by band, which is slow and time consuming. The horizontal screen has a relatively small surface area which may quickly clog when the inflow of debris is high. There is no handle for lifting the filter from the drain. U.S. Pat. No. 5,632,889 to Tharp discloses a similar filter.

U.S. Pat. No. 5,480,254 to Autry et al. discloses a runoff drain filter that comprises a box with porous vertical walls and an opening on the bottom. It is wider than a runoff drain for being positioned on top of and across it; it cannot be installed inside the runoff drain. Runoff water is filtered by the porous vertical walls as it flows through the filter and into the drain. The filter element of crushed stone is housed in a single chamber, but is too coarse to filter out anything but the largest pieces of debris. The filter element cannot be removed for cleaning or replacement.

Each of the prior art filters is provided with a single tray or container for collecting debris and contaminants. When the container is filled with heavy debris, such as sand and gravel from construction site runoff, the container may be much too heavy for an average person to lift out of the runoff drain. In that case, it can only be emptied by laboriously digging out the debris with a small shovel.

OBJECTIVES OF THE INVENTION

The objectives of the present runoff drain filter are:

- to filter out debris, sand, gravel, hydrocarbons, and other contaminants from water runoff flowing into a runoff drain;
- to collect a large amount of debris;
- to prolong filtering time;
- to continue unimpeded filtering even after collecting a large amount of debris;
- to be impossible to clog;
- to have filter cartridges which are easily replaced;
- to have cartridges which are easily lifted from the drain by an average person;
- to be usable for filtering large particles without becoming clogged; and
- to be also usable for filtering small particles and pollutants.

Further objectives of the present invention will become apparent from a consideration of the drawings and ensuing description.

BRIEF SUMMARY OF THE INVENTION

A runoff drain filter is comprised of a tray for being supported inside a runoff drain. A plurality of separately removable cartridges are supported by the tray and aligned with holes in the tray. Each cartridge is comprised of a bucket and an insert. The insert is comprised of a central overflow tube centered in the bucket by a vented annular top plate and an annular bottom plate. Runoff pouring into the tray is directed into each bucket through the vented annular top plate. The runoff is filtered by a perforated tube which is part of the central overflow tube before it is discharged through an open bottom of the central overflow tube. Debris and contaminants are collected in the buckets. The total capacity of the filter is divided among the separately removable cartridges to enable a filled cartridge to be more easily lifted by an average person.

DRAWING REFERENCE NUMERALS

| | |
|---|---|
| 10. | Tray |
| 11. | Wall |
| 12. | Bottom |
| 13. | Flange |
| 14. | Cartridge |
| 15. | Holes |
| 16. | Bucket |
| 17. | Insert |
| 18. | Handle |
| 19. | Open Top |
| 20. | Bottom |
| 21. | Central Overflow Tube |
| 22. | Top Plate |
| 23. | Louvers |
| 24. | Flange |
| 25. | Holes |
| 26. | Holes |
| 27. | Apertures |
| 28. | Runoff Drain |
| 29. | Bottom Plate |
| 30. | Resilient Seal |
| 31. | Top Tube |
| 32. | Bottom Tube |
| 33. | Perforated Tube |
| 34. | Hole |
| 35. | Debris |
| 36. | Space |
| 37. | Mesh |
| 38. | Insert |
| 39. | Second Perforated Tube |
| 40. | Filter Media |
| 41. | Space |
| 42. | Bucket |
| 43. | Closed Bottom |
| 44. | Entry Hole |
| 45. | Entry Hole |
| 46. | Flange |
| 47. | Exit Hole |
| 48. | Cartridge |
| 49. | Bucket |
| 50. | Closed Bottom |
| 51. | Insert |
| 52. | Inner Screen |
| 53. | Outer Screen |
| 54. | Filter Media |
| 55. | Closed Bottom |
| 56. | Annular Top |
| 57. | Handle |
| 58. | Entry Hole |
| 59. | Entry Hole |
| 60. | Flange |
| 61. | Central Bin |
| 62. | Exit Hole |

DETAILED DESCRIPTION OF THE INVENTION

Figure 1:
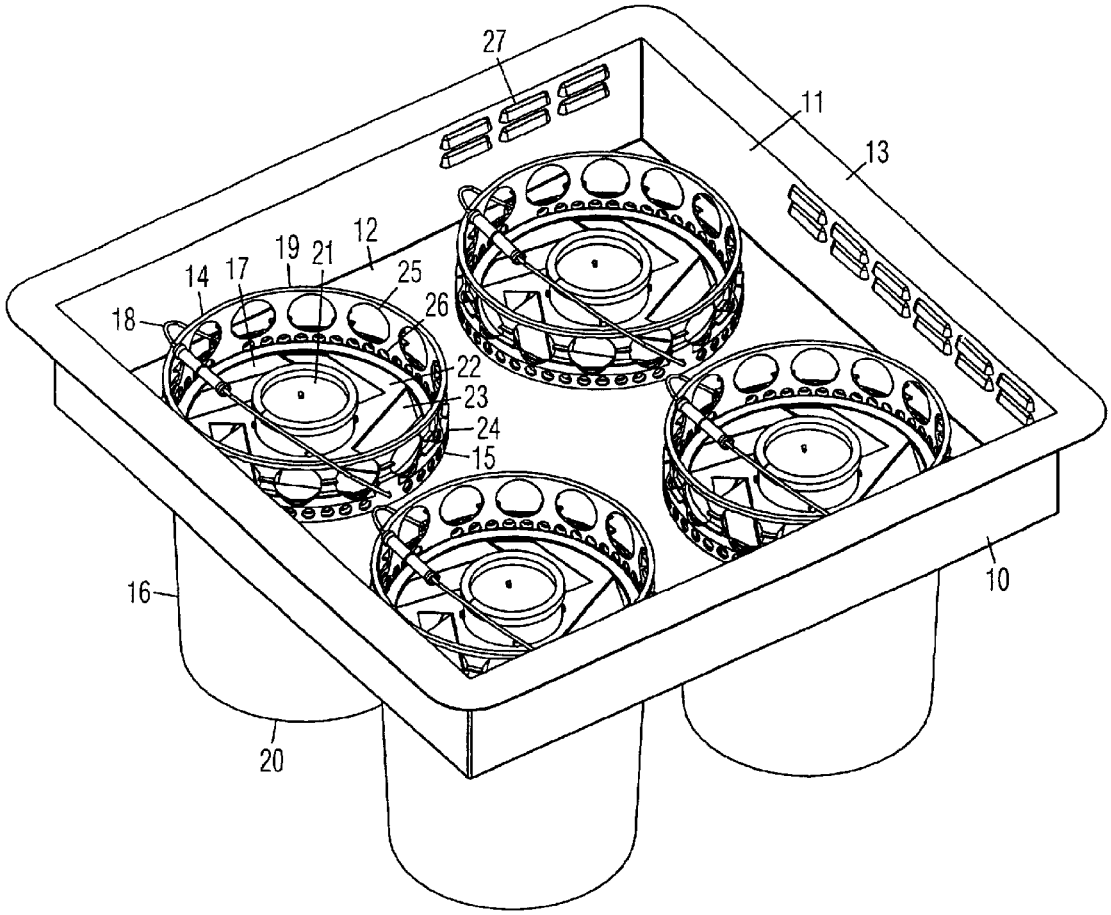
FIG. 1 is a top perspective view of the present runoff drain filter.

FIG. 1:

A first embodiment of the present runoff drain filter is shown in a top perspective view in FIG. 1. It is comprised of a tray 10 with a vertical surrounding wall 11, a bottom 12 at the lower end of wall 11, and a flange 13 around the top of wall 11. Although tray 10 is shown as a rectangular tray, it may be round or any other shape. A plurality of cartridges 14 are detachably supported by tray 10 and aligned with holes 15 in tray 10. Each cartridge 14 is comprised of a bucket 16 with an insert 17 and a handle 18. Bucket 16 has an open top 19 and a constricted bottom 20. Insert 17 is comprised of a central overflow tube 21 with open opposite ends generally coaxial with bucket 16, and an annular top plate 22 with louvers 23 arranged around central overflow tube 21. Adjacent the top end of each bucket 16 is a flange 24 which is supported by the rim of a corresponding hole 15 in tray 10. Since flange 24 is spaced substantially below a top rim of bucket 16, holes 25 and 26 are provided on bucket 16 above flange 24. Alternatively, flange 24 may be positioned closer to the top rim of bucket 16 so that holes 25 and 26 may be eliminated.

Tray 10 is sized for being supported within a runoff drain (not shown). The number of buckets 16 can vary according to the size of tray 10, and buckets 16 may be arranged in any pattern to suit the size and shape of tray 10. Bypass drainage apertures 27 (only a few are shown) are provided all around wall 11 of tray 10.

Bucket 16 is preferably a conventional 5-gallon plastic bucket, which is readily available and is of about the largest capacity that a man of average size can lift if the bucket is full of heavy debris. Alternatively, bucket 16 may be smaller, and it may be polygonal in cross section instead of round. Since the total capacity of the runoff drain filter is divided among several separate smaller cartridges instead of a single larger cartridge which can become extremely heavy when filled, the filter can be more easily emptied by removing the separate cartridges individually. Also, the separate cartridges are much deeper than filters with a single cartridge, so that the total capacity of the cartridges can be much greater than a single cartridge filter.

Figure 2:
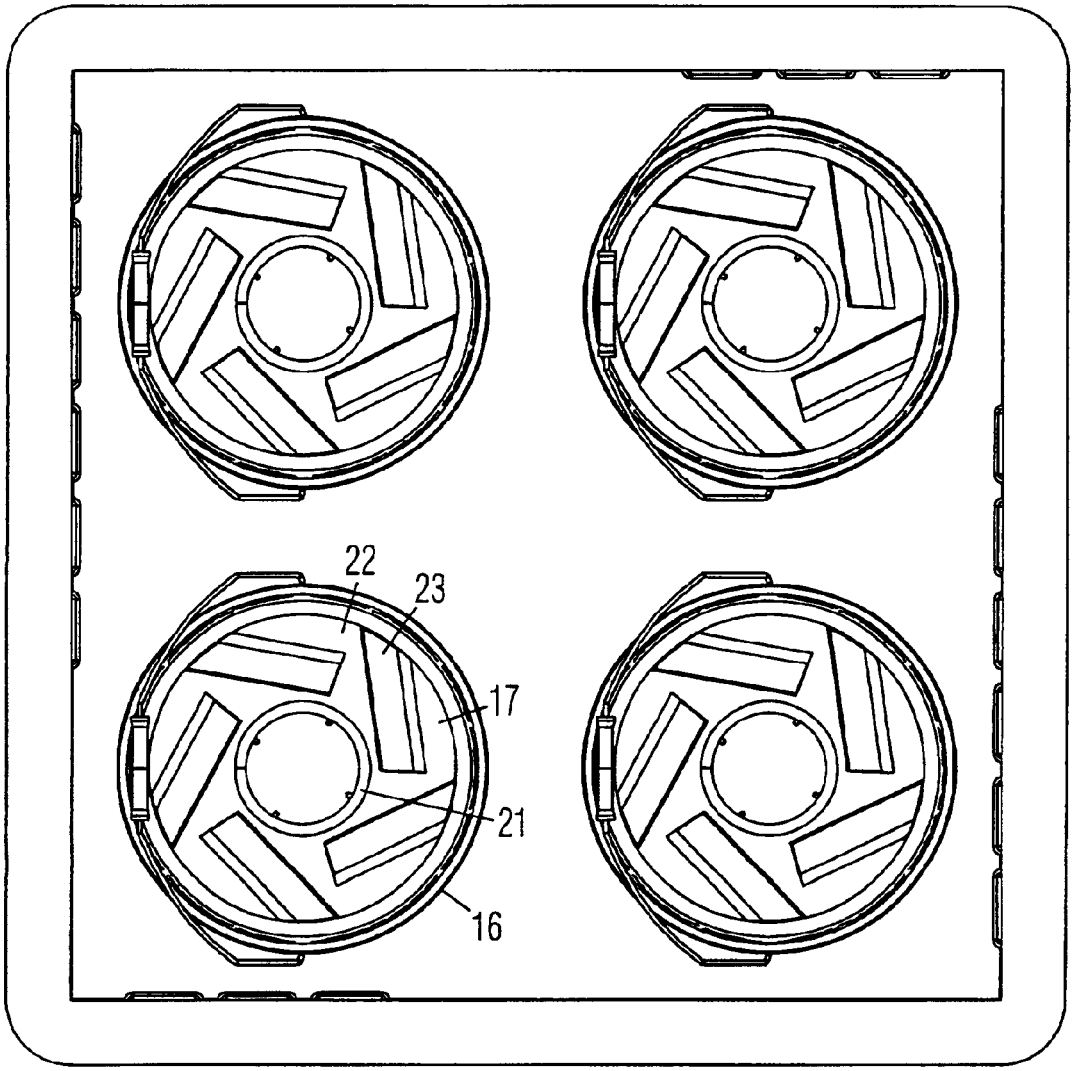
FIG. 2 is a top view thereof.

FIG. 2:

The runoff drain filter is shown in a top view in FIG. 2. Louvers 23 are arranged on annular top plate 22 of insert 17 around central overflow tube 21 for spinning runoff around against the inside of bucket 16. Louvers 23 are preferably generally tangent to central overflow tube 21 for maximizing their length.

Figure 3:
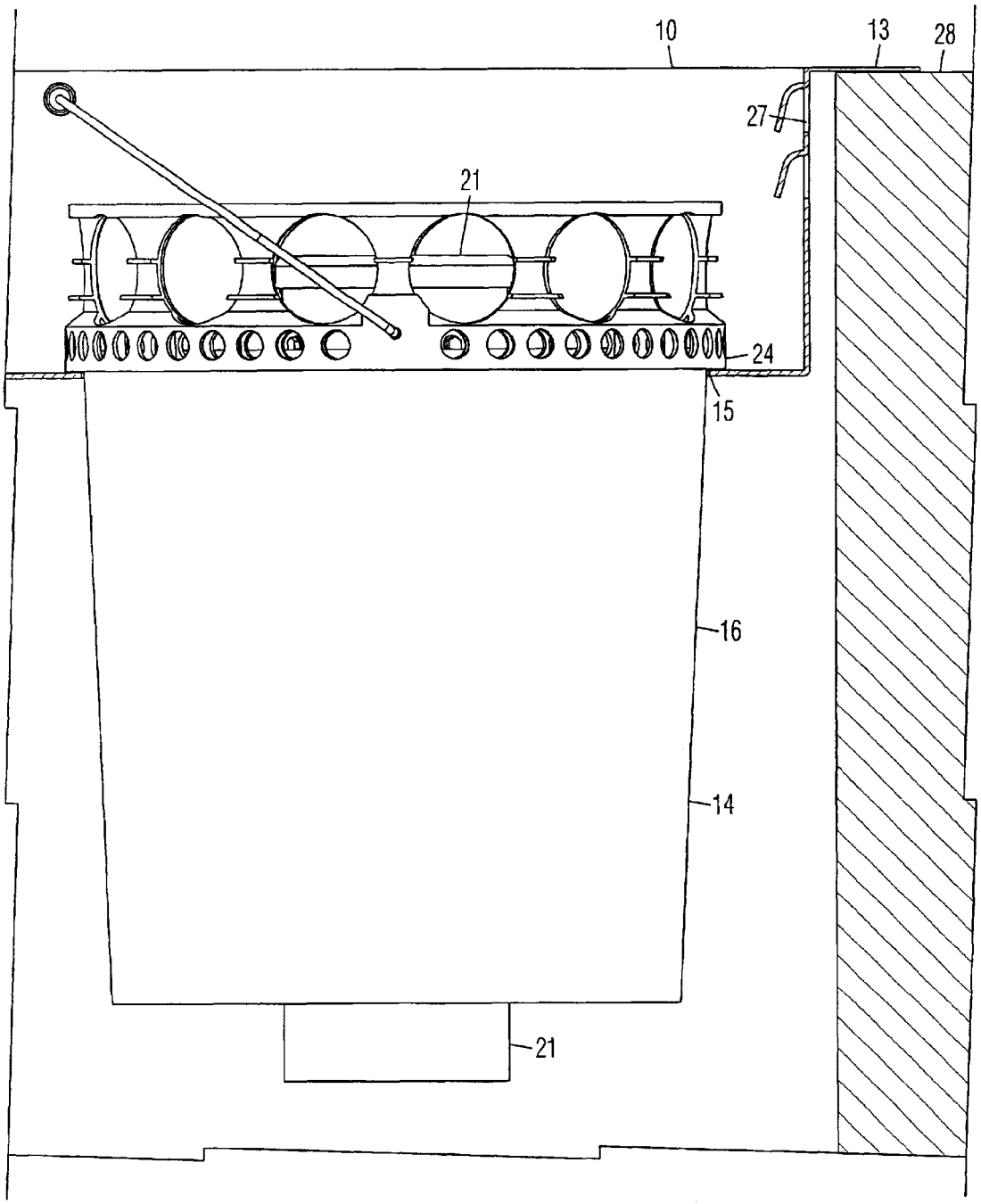
FIG. 3 is a side partial cutaway view thereof in a runoff drain.

FIG. 3:

The runoff drain filter is shown in a side view in FIG. 3 with tray 10 partially cut away and installed inside a runoff drain 28, which can be any type of drain for draining any type of runoff. Flange 13 of tray 10 is supported on the top rim of runoff drain 28. The grate (not shown) which is typically installed across the drain is positioned on top of the filter after the filter is installed. Cartridge 14 is supported by flange 24 of bucket 16 on the rim of a corresponding hole 15 in tray 10. Tray 10 is deep enough to support cartridge 14 low enough to position the top rim of bucket substantially below the top of tray 10. The top of central overflow tube 21 is preferably positioned below the top rim of bucket 16, and the bottom of central overflow tube 21 is preferably positioned below the bottom of bucket 16.

Figure 4:
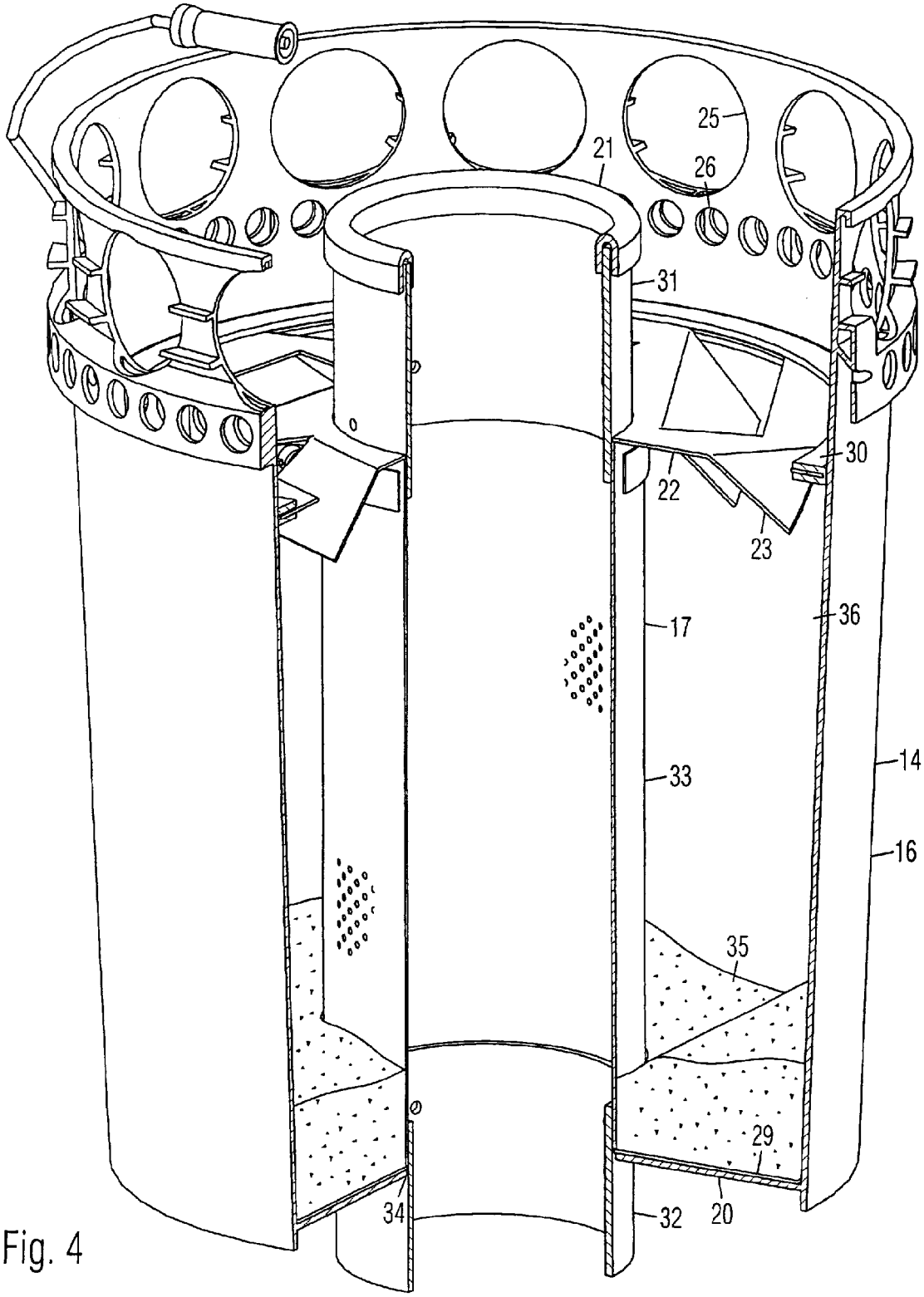
FIG. 4 is a perspective partial cutaway view of a cartridge thereof.

FIG. 4:

Cartridge 14 is shown in a cutaway view in FIG. 4. It is comprised of bucket 16 with insert 17 received therein. Insert 17 is comprised of central overflow tube 21 which is generally centered in bucket 16 by an annular bottom plate 29 and a vented annular top plate 22 with louvers 23. A resilient seal 30 is attached around the edge of top plate 22 and pressed against the interior of bucket 16. Bottom plate 29 of insert 17 is supported by a constricted bottom 20 of bucket 16. Central overflow tube 21 is comprised of a solid top tube 31 and a solid bottom tube 32 connected by a perforated tube 33. Central overflow tube 21 is arranged to project substantially above annular top plate 22 to direct runoff through said annular top plate 22. Bottom tube 32 is positioned through a hole 34 in constricted bottom 20 of bucket 16. Although constricted bottom 20 is shown as a ring, it may be of any other shape suitable for retaining insert 17, such as a plurality of radially arranged brackets. For rigidity, top plate 22 is attached to solid top tube 31, and bottom plate 29 is attached to solid bottom tube 32. Alternatively, top tube 31 and bottom tube 32 may be eliminated if perforated tube 33 is strong enough for attaching top plate 22 and bottom plate 29. Debris 35 is collected in an annular space 36 between bucket 16 and perforated tube 33, and between bottom plate 29 and top plate 22.

When runoff enters through holes 25 and 26 around the top of bucket 16, they are swirled against the interior of bucket 16 by oblique louvers 23. Particles in the runoff are forced by centrifugal force outward and away from perforated tube 33 to reduce clogging. Perforated tube 33 is provided with apertures sized for filtering relatively small debris, such as sand, silt, gravel, etc. As the bottom of perforated tube 33 is clogged by debris 35, the upper portion would still be clear to continue filtering for a relatively long time. When bucket 16 is full, the runoff can still drain through central overflow tube 21, albeit unfiltered.

Figure 5:
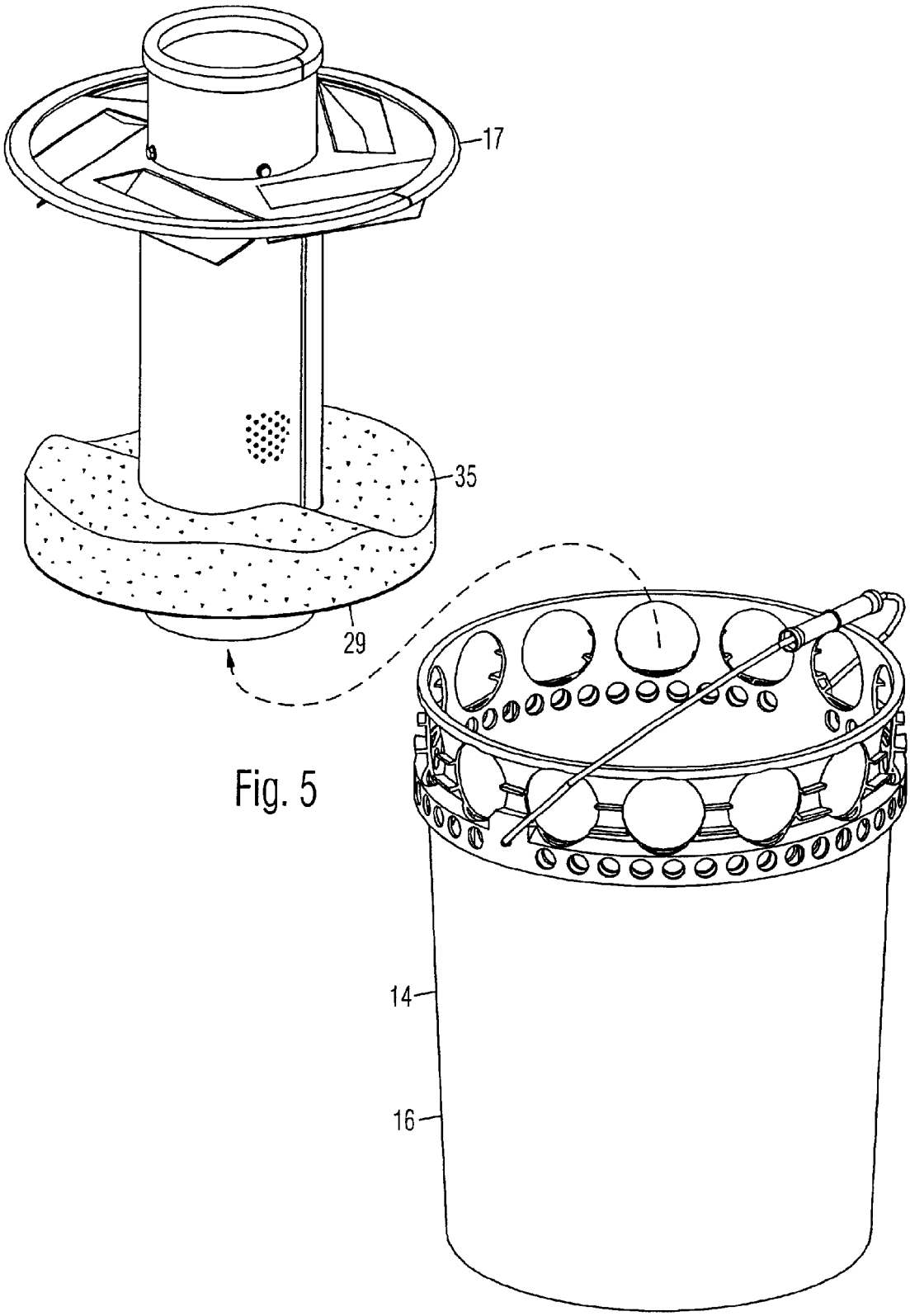
FIG. 5 is an exploded view of the cartridge.

FIG. 5:

Cartridge 14 is emptied by removing it from the tray (not shown) and removing insert 17 from bucket 16, as shown in FIG. 5. Debris 35 collected on top of annular bottom plate 29 of insert 17 may be removed by shaking or tapping it off.

Figure 6:
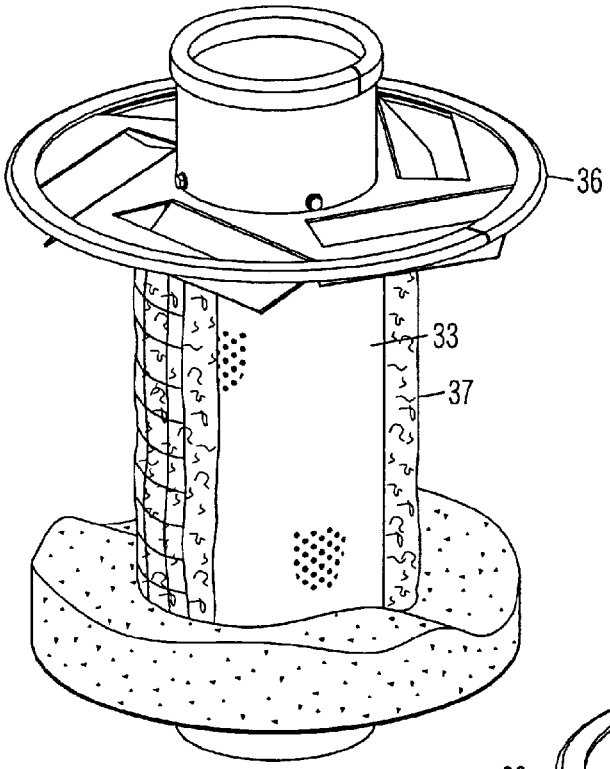
FIG. 6 is a perspective view of an alternative insert of the cartridge.

FIG. 6:

An alternative insert 36 is shown in FIG. 6. It is the same as that shown in FIG. 5, but further including a loose cushy mesh 37 wrapped around perforated tube 33 for improved filtration of small particles, such as sand and silt. Mesh 37 is preferably comprised of a geo-textile fabric of the type used for landscaping. Mesh 37 is shown partially cut away to reveal perforated tube 33 inside.

Figure 7:
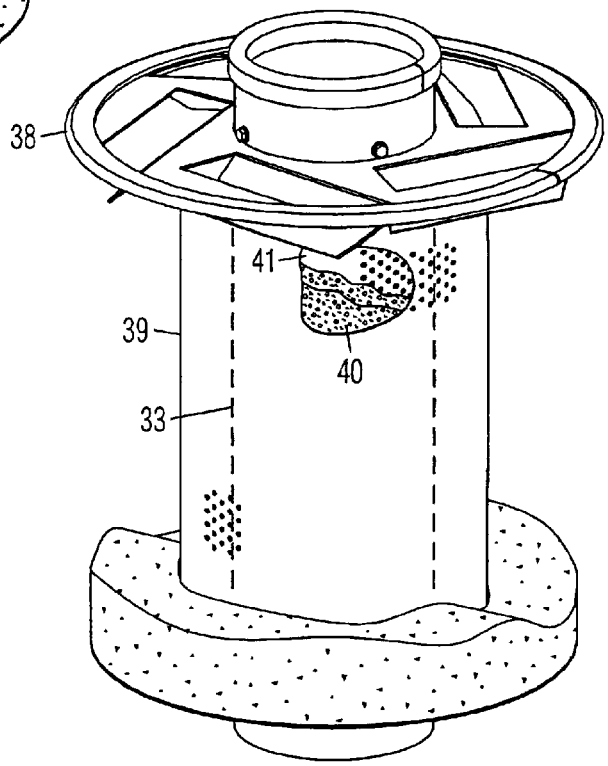
FIG. 7 is a perspective view of another alternative insert of the cartridge.

FIG. 7:

Another alternative insert 38 is shown in FIG. 7. It is the same as that shown in FIG. 5, but further including a larger diameter second perforated tube 39 positioned around perforated tube 33, and a filter media 40 received in a space 41 there between for filtering debris as well as hydrocarbons. Filter media 40 is preferably comprised of heat-expanded perlite which is treated to repel water but absorb oil, grease, and other hydrocarbons.

Figure 8:
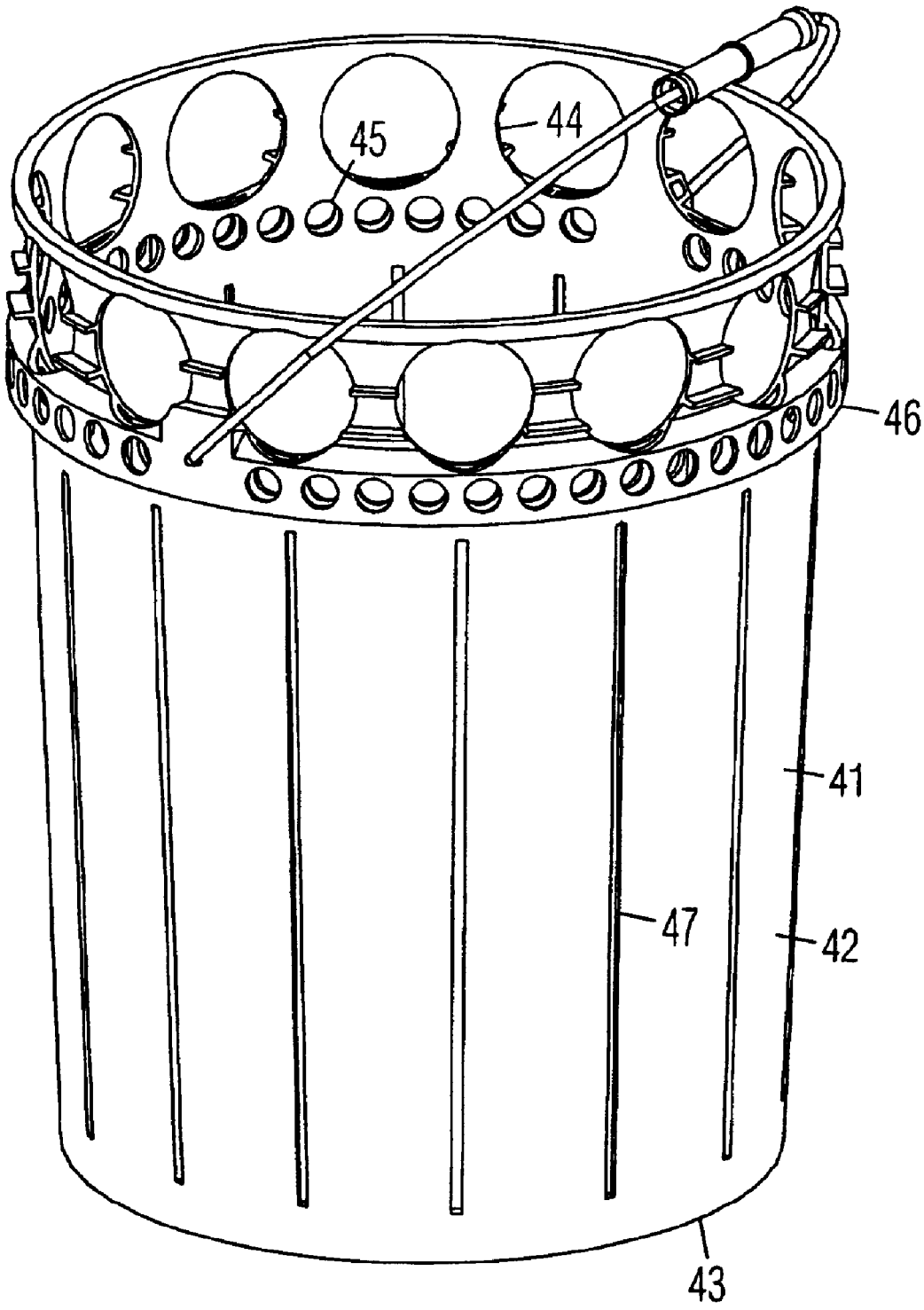
FIG. 8 is a perspective view of an alternative cartridge.

FIG. 8:

An alternative cartridge 41 shown in FIG. 8 is comprised of an open top bucket 42 without an insert, but with a fully closed bottom 43, entry holes 44 and 45 around a top rim above a supporting flange 46, and exit holes 47 all around bucket 42 below flange 46. Exit holes 47 are preferably sized for filtering larger debris, such as garbage. For example, exit holes 47 may be ⅛" to ¼" slits that extend between bottom 43 and flange 46.

Figure 9:
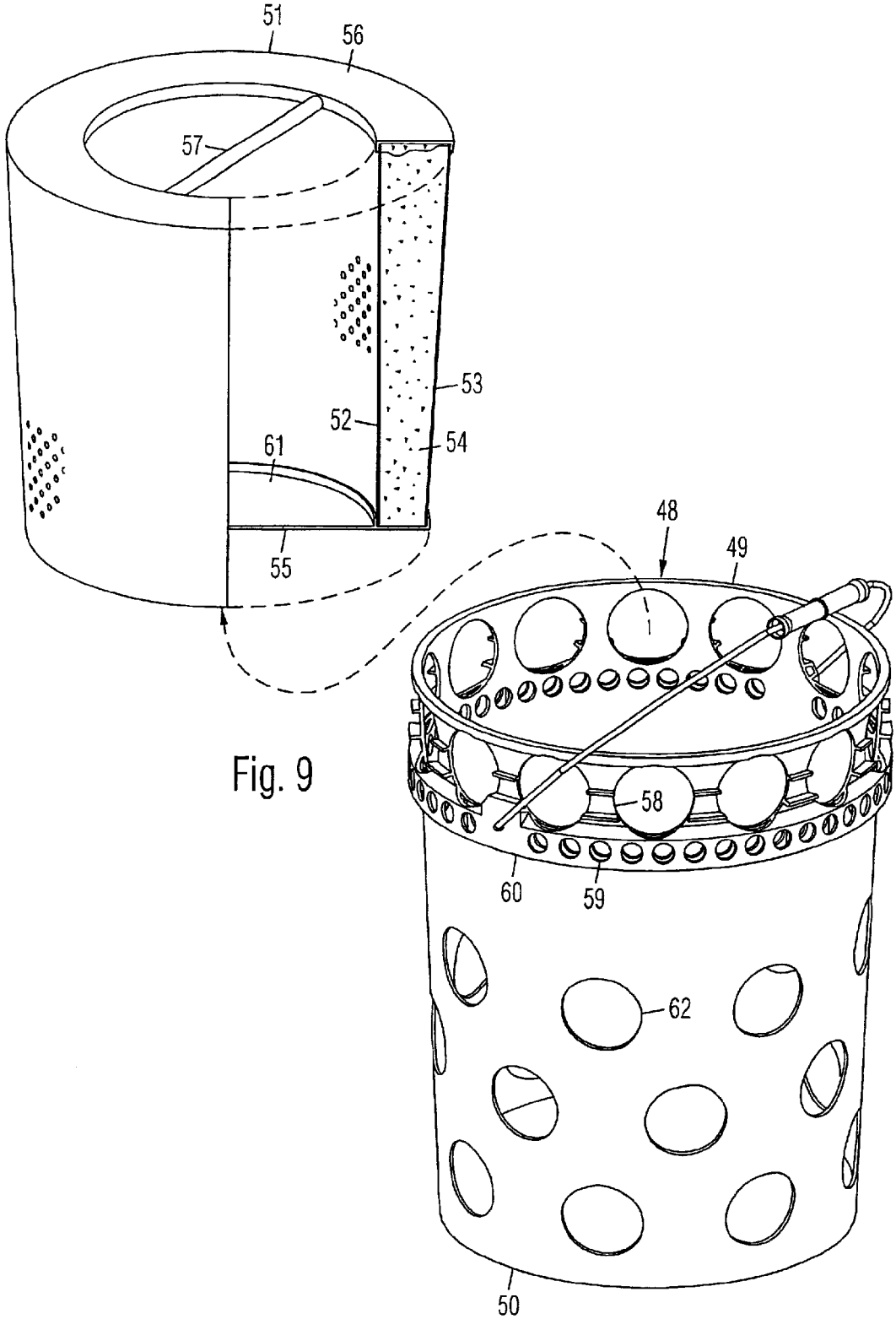
FIG. 9 is an exploded view of another alternative cartridge.

FIG. 9:

Another alternative cartridge 48 shown in FIG. 9 is comprised of an open top bucket 49 with a fully closed bottom 50. An insert 51 for bucket 49 is comprised of a tubular inner screen 52 and a tubular outer screen 53 enclosing filter media 54. Insert 51 has a fully closed bottom 55, an annular top 56, and a handle 57 across top 56. Alternatively, either bucket 49 or insert 51 can have an open bottom, as long as the other has a closed bottom.

Runoff flow into cartridge 48 through entry holes 58 and 59 around a top rim above a flange 60. The runoff is directed into a central bin 61 within inner screen 52, and is filtered by screens 52 and 53 and filter media 54 before discharging through large exit holes 62 all around bucket 49 below flange 60. Large debris and particles that cannot pass through inner screen are collected in central bin 61 for later disposal.

SUMMARY AND SCOPE

Although the foregoing description is specific, it should not be considered as a limitation on the scope of the invention, but only as an example of the preferred embodiment. Many variations are possible within the teachings of the invention. For example, different attachment methods, fasteners, materials, dimensions, etc. can be used unless specifically indicated otherwise. The relative positions of the elements can vary, and the shapes of the elements can vary. Therefore, the scope of the invention should be determined by the appended claims and their legal equivalents, not by the examples given.

I claim:

1. A runoff drain filter, comprising:

a tray for being supported in a runoff drain, said tray having a plurality of holes on a bottom; and a plurality of separately removable cartridges supported by said tray in alignment with said holes for filtering debris from runoff entering said drain, said cartridges dividing a total capacity of said filter into smaller portions for making removing said cartridges easier when said cartridges are full of said debris.

2. The runoff drain filter of claim 1, wherein each of said cartridges is comprised of an open top bucket with a fully closed bottom, and exit holes distributed around a vertical wall of said bucket.

3. The runoff drain filter of claim 1, wherein each of said cartridges is comprised of a 5-gallon bucket for limiting a weight of said debris collectable in said bucket.

4. The runoff drain filter of claim 1, wherein each of said cartridges is comprised of:

an open top bucket;

an insert positioned within said bucket, wherein said insert is comprised of:

a tubular inner screen;

a tubular outer screen; and filter media received between said inner screen and said outer screen for filtering said runoff; and a central bin within said inner screen, wherein said central bin includes an open top and a closed bottom for collecting said debris.

5. The runoff drain filter of claim 1, further including bypass drainage apertures around a surrounding wall of said tray.

6. A runoff drain filter, comprising:

a bucket for being supported in a runoff drain, said bucket having an open top, a constricted bottom, and a hole in said constricted bottom;

a removable insert positioned in said bucket, said insert comprising:

a central overflow tube with open opposite ends aligned with said hole on said constricted bottom of said bucket;

a vented annular top plate attached around said central overflow tube for admitting runoff between said bucket and said central overflow tube; and an annular bottom plate attached around said central overflow tube below said annular top plate for supporting debris; wherein said central overflow tube is comprised of a perforated tube for filtering said debris from said runoff; and said insert is supported in said bucket by said constricted bottom, and is removable from said bucket for emptying said debris.

7. The runoff drain filter of claim 1, wherein said central overflow tube is comprised of a solid top tube and a solid bottom tube connected by said perforated tube, said annular top plate is attached to said solid top tube for strength, and said annular bottom plate is attached to said solid bottom tube for strength.

8. The runoff drain filter of claim 1, wherein said bucket is comprised of a 5-gallon bucket for limiting a weight of said debris collectable in said bucket.

9. The runoff drain filter of claim 1, further including louvers arranged on said annular top plate of said insert for spinning runoff against said bucket for reducing clogging.

10. The runoff drain filter of claim 1, further including a resilient seal attached around an edge of said annular top plate and movably pressed against bucket.

11. The runoff drain filter of claim 1, further including a loose cushy mesh wrapped around said perforated tube for improved filtration.

12. The runoff drain filter of claim 1, further including a larger diameter second perforated tube positioned around perforated tube, and a filter media received between said perforated tube and said second perforated tube for filtering hydrocarbons.

13. A runoff drain filter, comprising:

a tray for being supported in a runoff drain, said tray having a plurality of holes on a bottom;

a plurality of separately removable cartridges supported by said tray in alignment with said holes on said tray for filtering debris from runoff entering said drain, said cartridges dividing a total capacity of said filter into smaller portions for making removing said cartridges easier when said cartridges are full of said debris, each of said cartridges comprising:

a bucket with an open top, a constricted bottom, and a hole in said constricted bottom;

a removable insert positioned in said bucket, said insert comprising:

a central overflow tube with open opposite ends aligned with said hole in said constricted bottom of said bucket;

a vented annular top plate attached around said central overflow tube for admitting said runoff between said bucket and said central overflow tube; and an annular bottom plate attached around said central overflow tube below said annular top plate for supporting said debris; wherein said central overflow tube is comprised of a perforated tube for filtering said debris from said runoff; and said insert is supported in said bucket by said constricted bottom, and is removable from said bucket for emptying said debris.

14. The runoff drain filter of claim 13, wherein said central overflow tube is comprised of a solid top tube and a solid bottom tube connected by said perforated tube, said annular top plate is attached to said solid top tube for strength, and said annular bottom plate is attached to said solid bottom tube for strength.

15. The runoff drain filter of claim 13, wherein said bucket is comprised of a 5-gallon bucket for limiting a weight of said debris collectable in said bucket.

16. The runoff drain filter of claim 13, further including louvers arranged on said annular top plate of said insert for spinning runoff around against said bucket for reducing clogging.

17. The runoff drain filter of claim 13, further including bypass drainage apertures around a surrounding wall of said tray.

18. The runoff drain filter of claim 13, further including a resilient seal attached around an edge of said annular top plate and movably pressed against bucket.

19. The runoff drain filter of claim 13, further including a loose cushy mesh wrapped around said perforated tube for improved filtration.

20. The runoff drain filter of claim 13, further including a larger diameter second perforated tube positioned around perforated tube, and a filter media received between said perforated tube and said second perforated tube for filtering hydrocarbons.

* * * * *